US009521916B2

(12) United States Patent
Miller

(10) Patent No.: US 9,521,916 B2
(45) Date of Patent: Dec. 20, 2016

(54) SYSTEM AND METHOD FOR HANGING PICTURE FRAMES

(71) Applicant: Roger H Miller, Iowa City, IA (US)

(72) Inventor: Roger H Miller, Iowa City, IA (US)

( * ) Notice: Subject to any disclaimer, the term of this patent is extended or adjusted under 35 U.S.C. 154(b) by 10 days.

(21) Appl. No.: 14/556,499

(22) Filed: Dec. 1, 2014

(65) Prior Publication Data

US 2015/0144756 A1 May 28, 2015

Related U.S. Application Data

(63) Continuation of application No. 13/884,071, filed as application No. PCT/US2011/061146 on Nov. 17, 2011, now Pat. No. 8,898,945.

(60) Provisional application No. 61/415,167, filed on Nov. 18, 2010.

(51) Int. Cl.

| | |
|---|---|
| ***A47G 1/06*** | (2006.01) |
| ***A47G 1/16*** | (2006.01) |
| ***A47G 1/20*** | (2006.01) |
| ***B25H 7/04*** | (2006.01) |

(52) U.S. Cl.

CPC ..... *A47G 1/1633* (2013.01); *A47G 1/162* (2013.01); *A47G 1/205* (2013.01); *B25H 7/04* (2013.01)

(58) Field of Classification Search

CPC ..... A47G 1/16; A47G 1/1606; A47G 1/1613; A47G 1/1262; A47G 1/1633; A47G 1/164

See application file for complete search history.

(56) References Cited

U.S. PATENT DOCUMENTS

| | | | | |
|---|---|---|---|---|
| 4,220,309 | A | 9/1980 | Eisen et al. | |
| 5,605,313 | A | 2/1997 | Erickson et al. | |
| 6,952,887 | B2 * | 10/2005 | Muchnik | 33/666 |
| 7,293,925 | B1 * | 11/2007 | Sanseviero | 401/48 |
| 7,380,346 | B1 * | 6/2008 | Emerson | 33/613 |
| 7,836,604 | B2 | 11/2010 | Paharik et al. | |
| 7,946,051 | B1 | 5/2011 | Hannah et al. | |
| 2002/0078582 | A1 * | 6/2002 | Krake et al. | 33/613 |
| 2004/0216319 | A1 | 11/2004 | Muchnik | |
| 2008/0078916 | A1 | 4/2008 | Nevers | |
| 2009/0165319 | A1 * | 7/2009 | Gallien | 33/666 |
| 2009/0193674 | A1 | 8/2009 | Megahed | |
| 2009/0313843 | A1 | 12/2009 | Compton | |

* cited by examiner

*Primary Examiner* — Kristina Junge

(74) *Attorney, Agent, or Firm* — Simmons Perrine Moyer Bergman PLC

(57) ABSTRACT

A system and method for hanging a picture frame on a wall, comprising the steps of providing a picture frame with a hanger, for receiving a nail therein and a marking device temporarily secured to the picture frame and disposed near the void for receiving the nail; pressing the picture frame with the marking device protruding out from the picture frame, so that the marking device makes a perceivable mark on the wall, then removing the marking device; inserting a nail, screw or a length adjustable wall auger into the wall at the mark; and hanging the picture with the hanger so that the nail, screw or a length adjustable wall auger occupies some of the space earlier occupied by the marking device.

8 Claims, 7 Drawing Sheets

SYSTEM AND METHOD FOR HANGING PICTURE FRAMES

RELATED APPLICATIONS

This application is a continuation application of Ser. No. 13/884,071, filed on May 8, 2013, now U.S. Pat. No. 8,898,945, issued on Dec. 2, 2014, which is a §371 national stage application of PCT/US11/061146, filed on Nov. 17, 2011, which in turn claims the benefit of provisional application Ser. No. 61/415,167, filed on Nov. 18, 2010, all of which are incorporated in their entirety by reference.

FIELD OF THE INVENTION

The present invention generally relates to hand tools and more particularly to systems for hanging picture frames.

BACKGROUND OF THE INVENTION

In the past, many people wishing to securely hang a picture at a precise location on a wall so as to hang level with the ground and to resist being perturbed have had difficulty completing the task.

While many prior art approaches of picture hanging have been employed in the past, they do have some drawbacks. First of all, hanging a picture frame with a single nail or screw often results in it being accidentally perturbed from a level position when someone walks by and brushed up next to the picture, or if the wall holding the picture shakes, when a nearby door is slammed. Secondly, using two or more precisely measured nail locations have often proved difficult for many people.

Consequently, there exists a need for improved methods and systems for hanging picture frames without some of the drawbacks of the prior art systems.

SUMMARY OF THE INVENTION

It is an object of the present invention to provide a system and method for hanging picture frames in an efficient manner.

It is a feature of the present invention to utilize a dual purpose hanging and wall marking structure on a picture frame.

It is an advantage of the present invention to reduce the time required to properly mark nail hole locations.

It is another advantage of the present invention to reduce errors in marking the location of nail holes.

It is another feature of the present invention to include a level which is sized and constructed so as to sit on a top horizontal portion of a picture frame in a stable manner.

It is an advantage of the present invention to allow a picture to be leveled by grasping the picture frame while the level remains positioned atop the picture frame to be hung.

It is a feature of the present invention to include a method which allows the person hanging the picture frame to visually locate the picture and hang it without the need for any distance measuring.

It is an advantage of the present invention to reduce the errors which often occur with picture hanging.

The present invention is a system and method for securely hanging pictures, designed to satisfy the aforementioned needs, provide the previously stated objects, include the above-listed features, and achieve the already articulated advantages. The present invention is carried out in a "distance measuring-less" manner, in a sense that the need to measure distances of nail holes in relation to other nail holes or structure on the picture frame, has been eliminated.

Accordingly, the present invention is a system and method including a dual purpose hanging and marking structure on a picture frame.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
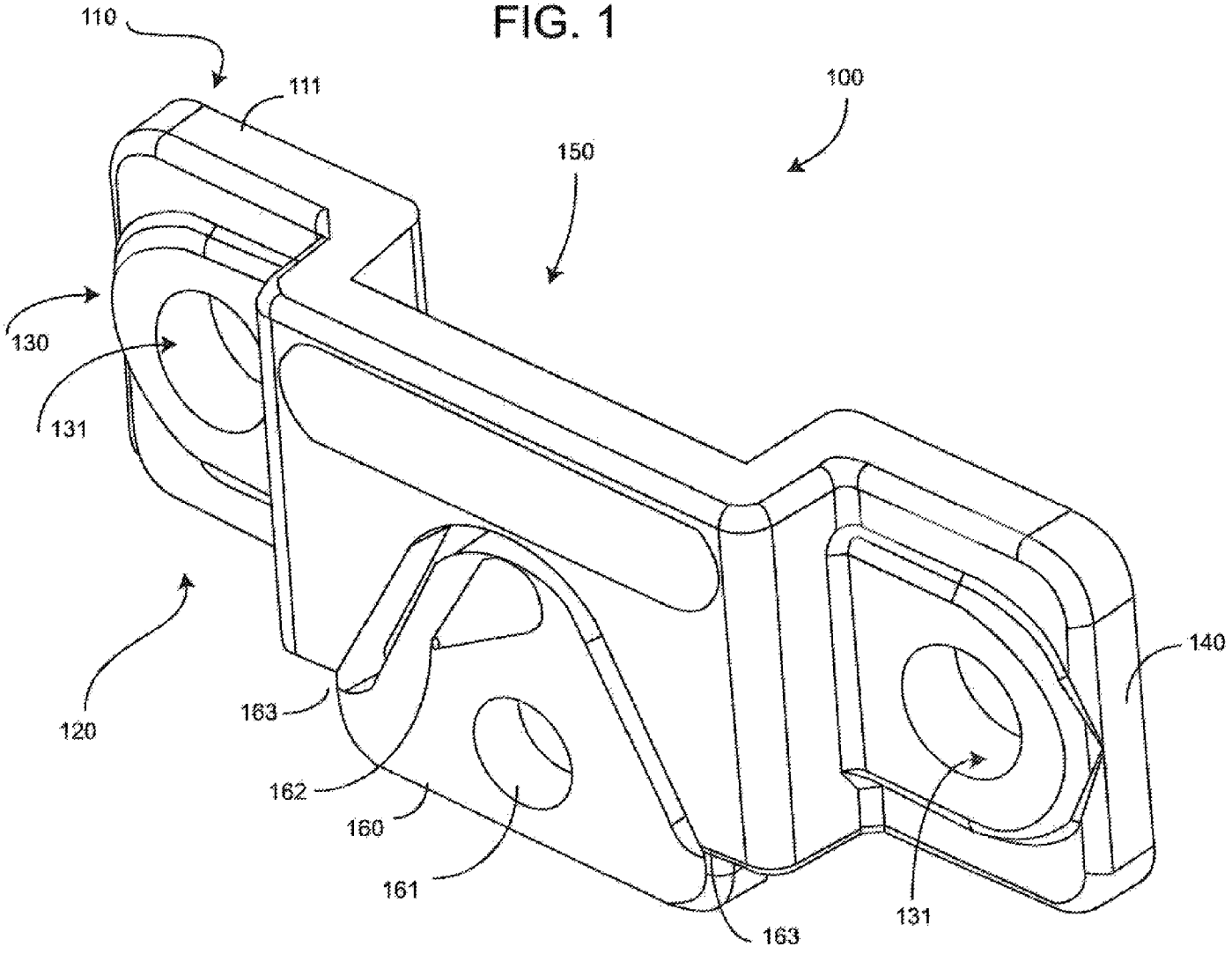
FIG. 1 is a perspective view of a wall side of a dual purpose hanging and marking structure of the present invention.

Now referring to the drawing wherein like numerals refer to like matter throughout, and more specifically referring to FIG. 1, there is shown a dual purpose hanging and marking structure 100 which may be a unified molded plastic piece or it may be a metal piece or assembly. Cost, weight requirements and other application specifics may dictate material choices and manufacturing methodologies. Injection molded plastic may be a preferred embodiment for some residential applications. Dual purpose hanging and marking structure 100 has a dual purpose hanging and marking structure top side 110, dual purpose hanging and marking structure bottom side 120, dual purpose hanging and marking structure left side 130 and dual purpose hanging and marking structure right side 140. Dual purpose hanging and marking structure central protruding section 150 is disposed between dual purpose hanging and marking structure left side 130 and dual purpose hanging and marking structure right side 140. Disposed within dual purpose hanging and marking structure 100 may be at least one dual purpose hanging and marking structure frame attachment screw receiving hole 131. The terms screw and nail are used interchangeably herein and both are intended to refer to the other. Other ways of attaching one object to another could be utilized instead of screws or nails, such as wall augers, adhesives, welding, bolts, clamps and any other suitable attachment scheme. It should also be understood that the present invention may include the dual purpose hanging and marking structure 100 which has been formed integrally as part of a picture frame or a component thereof. It also should be understood that the present invention is not intended to be restricted to picture frames, which terms are used throughout as a mere example of the many types of things that might be hung on a wall, such as signs, rugs or any object.

Dual purpose hanging and marking structure top side 110 has a dual purpose hanging and marking structure central removable section 160 disposed therein which is used during the early stages of the process and then removed before the actual final placement of the picture frame is made. Dual purpose hanging and marking structure central removable section 160 is shown to include a dual purpose hanging and marking structure central removable section marking structure 162 which may mark a wall by leaving a substance (e.g. chalk, pencil lead, ink, paint, etc.) on the wall or by causing a dent, whole or other surface marking to occur. Dual purpose hanging and marking structure central removable section attachment portions 163 are included to provide for temporary attachment of the dual purpose hanging and marking structure central removable section 160 to the dual purpose hanging and marking structure central protruding section 150 so that it can be easily removed once the wall has been marked. Dual purpose hanging and marking structure central removable section removal assisting hole 161 may be included to allow a pencil or other object to be inserted therein to assist in twisting the dual purpose hanging and marking structure central removable section 160 enough to break the dual purpose hanging and marking structure central removable section attachment portions 163 in order to accomplish detachment and removal. Note, the present invention discusses hanging something on a wall, this is intended a an example and the system and method of the present invention could be used to hang objects on to things other than walls, such as furniture or any suitable place where something might be hung. The dual purpose hanging and marking structure central protruding section 150 is indented so as to allow for space to accommodate screw, nail or bolt heads or any other structure to help secure the dual purpose hanging and marking structure 100 to the wall.

Figure 2:
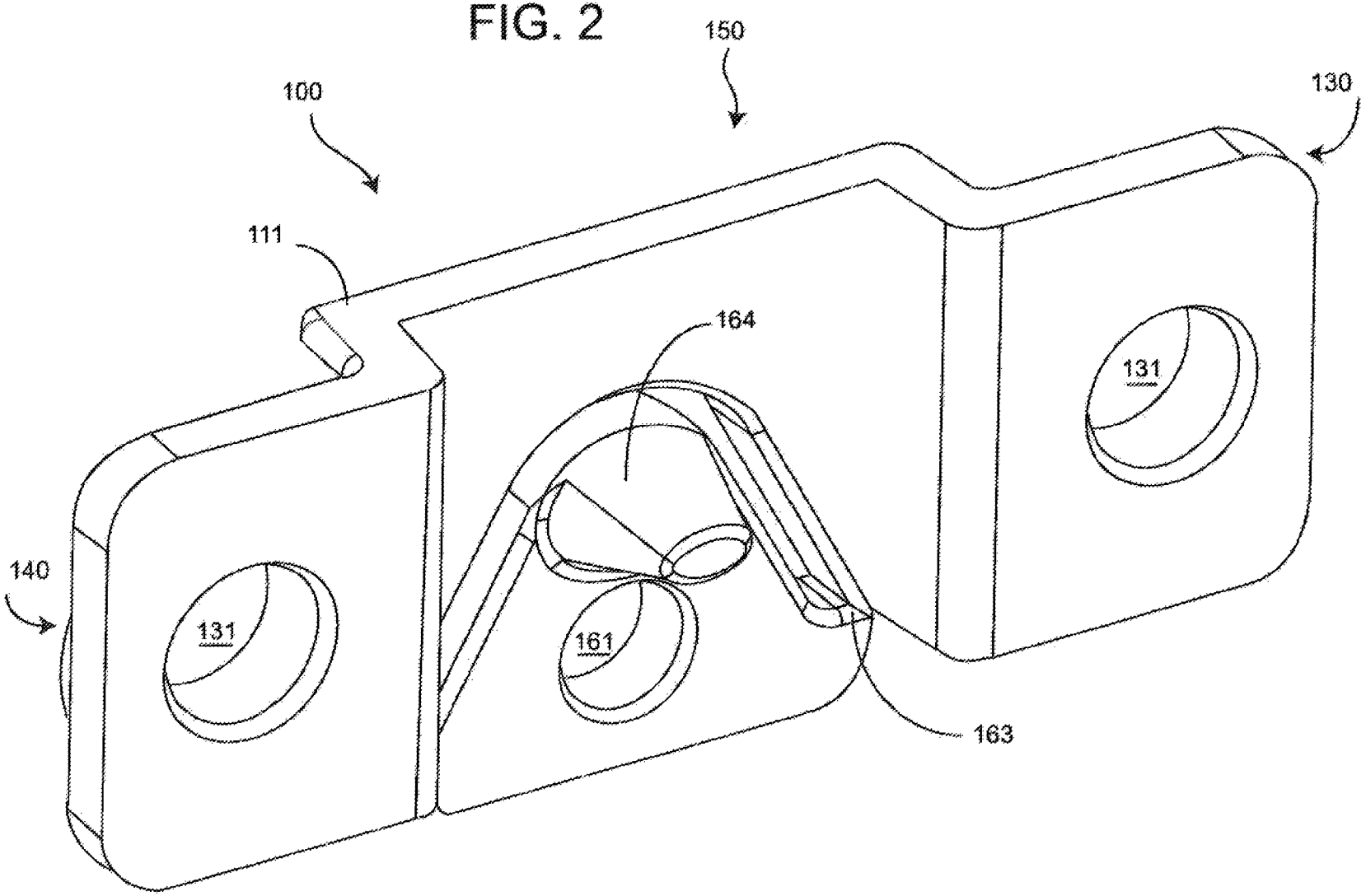
FIG. 2 is an opposing frame side of the dual purpose hanging and marking structure of FIG. 1.

Now referring to FIG. 2, there is shown a wall side of the dual purpose hanging and marking structure 100 of FIG. 1. There is shown a dual purpose hanging and marking structure central removable section marking structure back support structure 164 which is provided to give support to the dual purpose hanging and marking structure central protruding section 150 when the dual purpose hanging and marking structure central removable section marking structure 162 is pressed against the wall. Dual purpose hanging and marking structure central removable section marking structure back support structure 164 helps reduce unwanted and undesirable deflection or twisting of the dual purpose hanging and marking structure central removable section 160 when the dual purpose hanging and marking structure central removable section marking structure 162 is pressed against the wall to make a mark.

Figure 3:
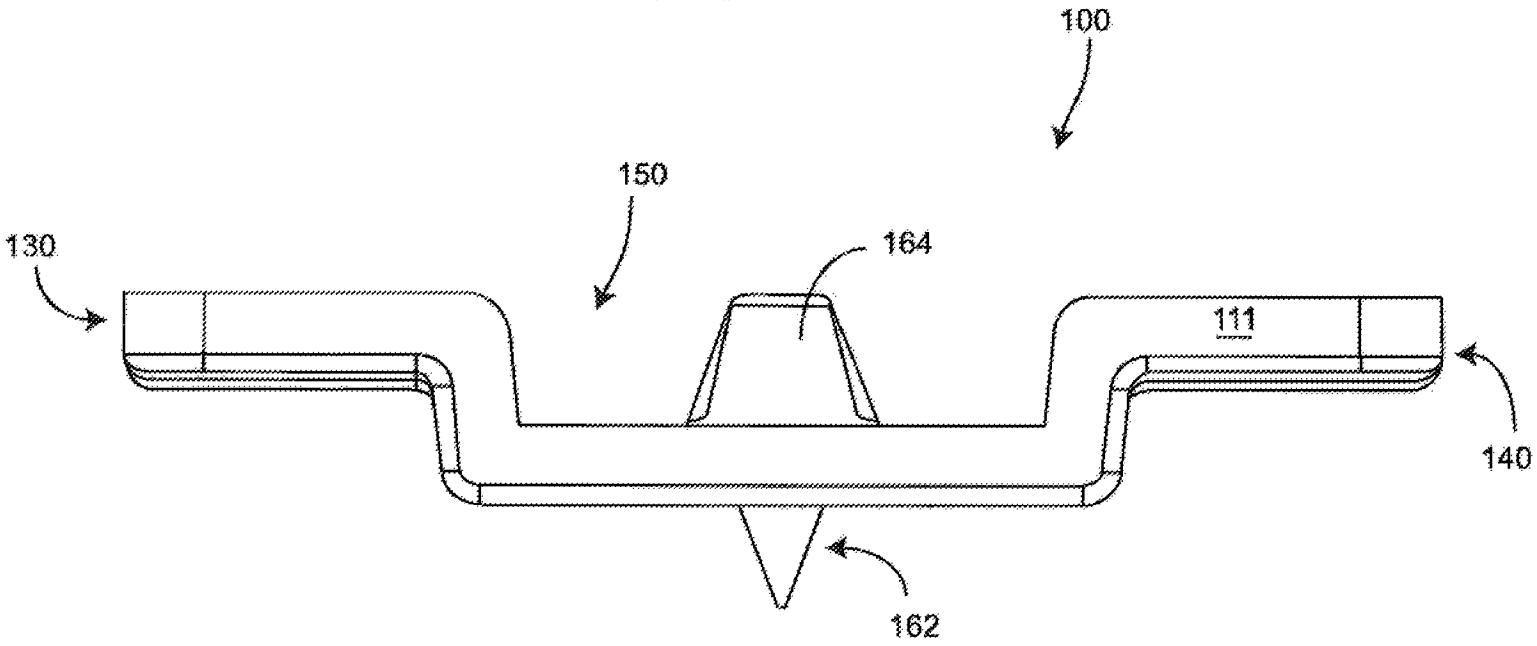
FIG. 3 is a top view of the dual purpose hanging and marking structure of FIG. 1.

Now referring to FIG. 3, there is shown a top view of the dual purpose hanging and marking structure 100 of FIG. 1.

Figure 4:
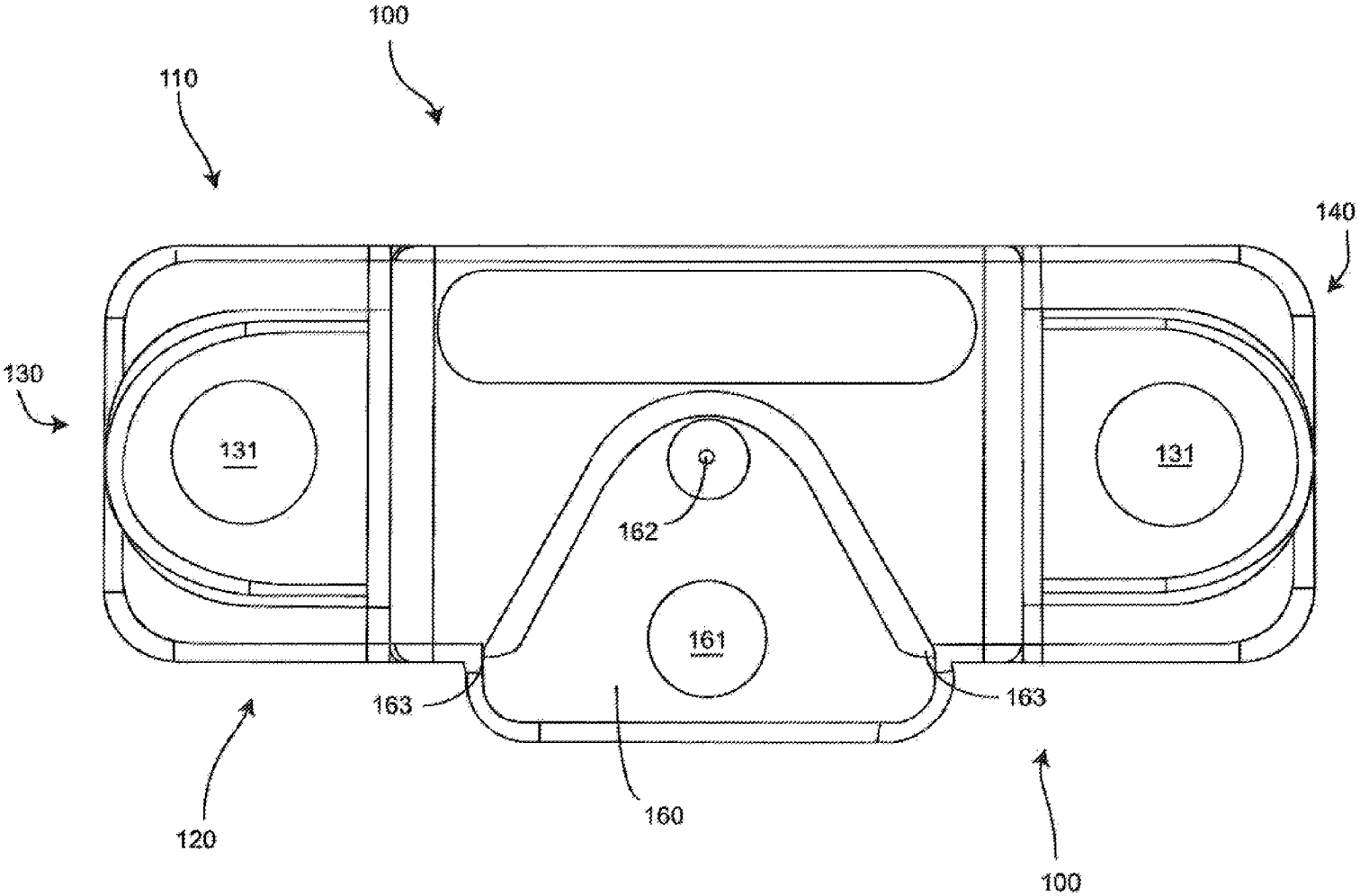
FIG. 4 is wall side view of the dual purpose hanging and marking structure of FIG. 1.

Now referring to FIG. 4, there is shown a front view of the dual purpose hanging and marking structure 100 of FIG. 1.

Figure 5:
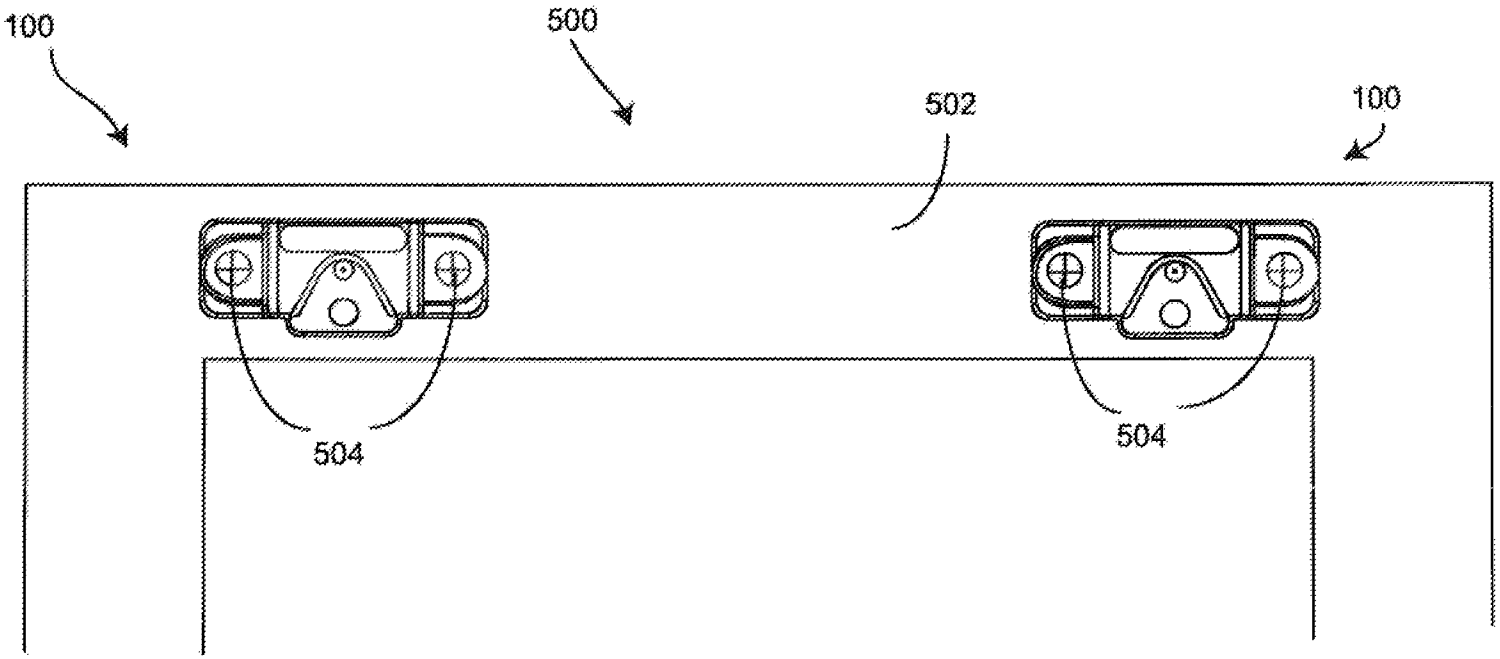
FIG. 5 is a view of two dual purpose hanging and marking structures mounted on a wall side of a picture frame.

Now referring to FIG. 5, there is shown two dual purpose hanging and marking structures mounted on a wall side of a top portion of a picture frame.

In operation, the system and method of the present invention can operate as follows:

Step 1. Attach a first dual purpose hanging and marking structure 100 to a picture frame;

Step 2. Attach a second dual purpose hanging and marking structure 100 to the picture frame. Note, the location on the picture frame is not limited to a particular single spot on the picture frame. It is preferred to place the dual purpose hanging and marking structures 100 being located on the wall side of the picture frame near its top and separate the first and a second dual purpose hanging and marking structure 100 by some distance.

Step 3. The picture frame is placed against the wall and leveled or oriented to some desired non-level orientation and pressed against the wall to leave a mark. When the leveling is accomplished it can be done with a standing and tapeable level of FIGS. 7 and 8. For example, the level can be positioned on the wall and oriented in a level arrangement. Tape is then applied to the wings holding the level to the wall. The picture frame then can rest on the top lip or ledge of the level and can be translated back and forth to the desired lateral position, alternately the level can be stood on top of the frame on the bottom lip of the level and the combination of the frame and level are moved to a level arrangement. When the pressing occurs the dual purpose hanging and marking structure central removable section marking structure 162 leaves some sort of visual indication of the location of each of the dual purpose hanging and marking structure central removable section marking structures 162.

Step 4. The dual purpose hanging and marking structure central removable section 160 is removed from the dual purpose hanging and marking structure central protruding section 150.

Step 5. A screw is placed into the wall at the location of the marks made by the dual purpose hanging and marking structure central removable section marking structure 162.

Step 6. The picture then is hung on the screws so that the screw into the wall engages the dual purpose hanging and marking structure central protruding section 150 at the former location of the dual purpose hanging and marking structure central removable section 160.

The above procedure assumes that the dual purpose hanging and marking structure 100 has a dual purpose hanging and marking structure central removable section 160 included therein which is a single use dual purpose hanging and marking structure 100. In alternate embodiments of the present invention, the dual purpose hanging and marking structure central removable section 160 is not attached to the dual purpose hanging and marking structure 100 by dual purpose hanging and marking structure central removable section attachment portions 163.

Figure 6:
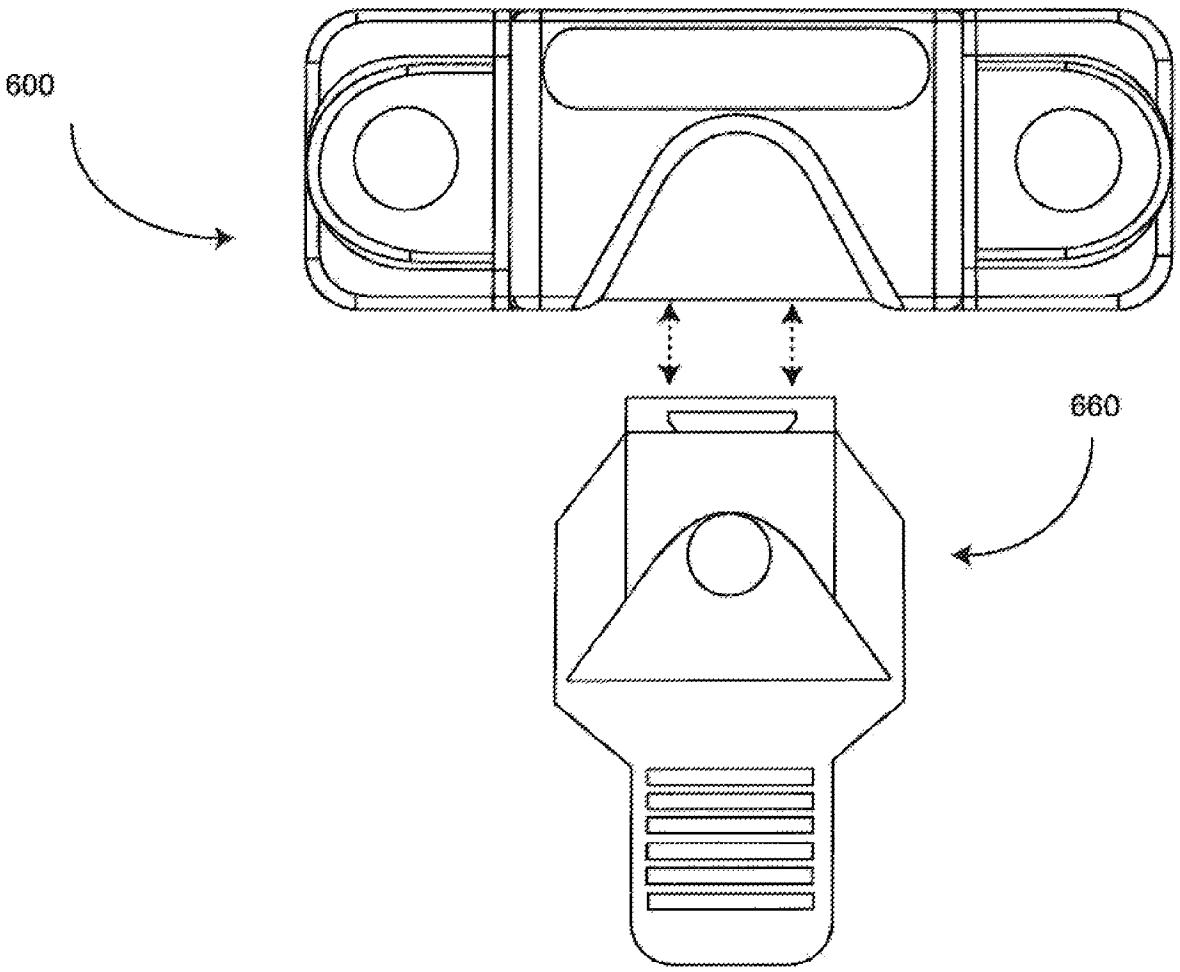
FIG. 6 is an exploded front view of an alternate embodiment of the present invention with a reusable marking structure.

Now referring to FIG. 6, there is shown, a reusable dual purpose hanging and marking structure central detachable section 660 which is inserted into a reusable dual purpose hanging and marking structure 600 which is configured to detachably receive therein the reusable dual purpose hanging and marking structure central detachable section 660 which may be a snap in module that can be readily inserted and removed from the reusable dual purpose hanging and marking structure 600. In another embodiment of the present invention, the reusable dual purpose hanging and marking structure 600 could be formed by the frame manufacturer into the picture frame itself. This could be done so that reusable dual purpose hanging and marking structure central detachable section 660 can mate with this integral structure or the reusable dual purpose hanging and marking structure 600. In yet another alternate, the reusable dual purpose hanging and marking structure central detachable section 660 could be simplified to just being removable marking plugs and the reusable dual purpose hanging and marking structure 600 is simplified into just being holes drilled or formed in the picture frame to receive the removable marking plugs.

Figure 7:
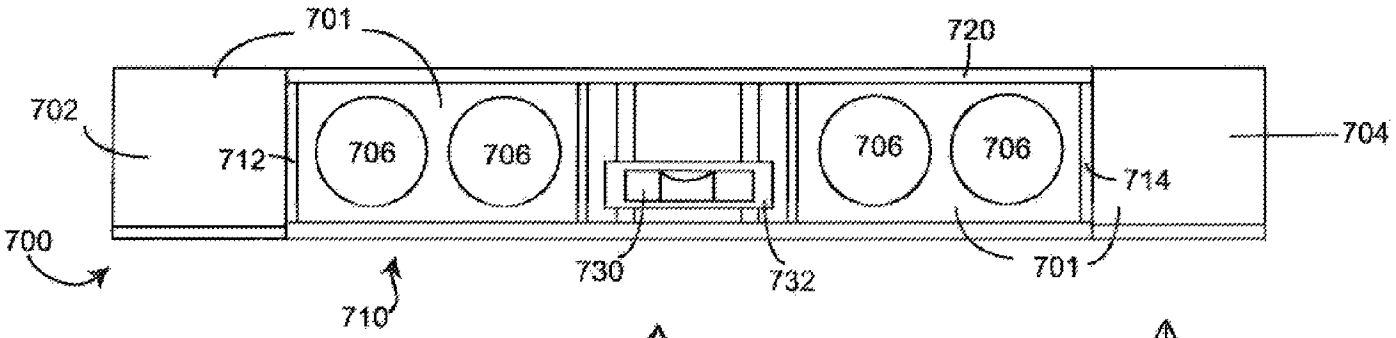
FIG. 7 is a front view of a standing and tapeable level of the present invention.
Figure 8:
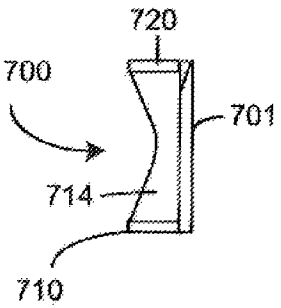
FIG. 8 is an end view of the level of claim 7.

Now referring to FIG. 7, there is shown a specialized level of the present invention generally designated 700 having a left side taping wing 702 and a right side taping wing 704 which are preferably quite thin, so as to facilitate being taped to a wall. Level 700 has a plurality of weight reducing holes 706 and has a flat standing lip 710 which can sit atop a picture frame. Note, the side taping wings 702 and 704 are preferably so thin that the level could not stand atop a frame while it is being leveled, if there were no flat standing lip 710. Also shown, is a left lip buttress 712 and a right lip buttress 714. There is shown a top lip 720 which may be omitted from a preferred embodiment to reduce weight. Also, if top lip 720 is omitted, the buttresses 712 and 714 could be made to terminate on an intermediate section of the planar body 701 of the level 700. FIG. 8 shows an end view with the full length buttresses and top lip 720. If top lip 720 were omitted, buttresses could be a triangle extending about half way up the planar back 701.

Figure 10:
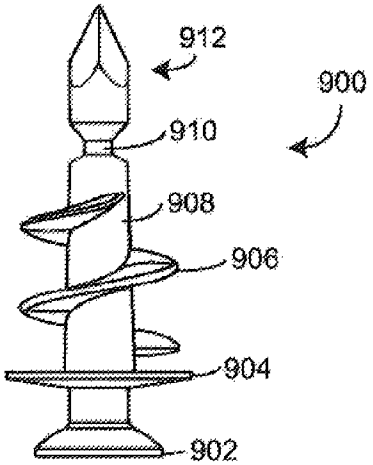
FIG. 10 is a side view of the wall auger of FIG. 9.
Figure 9:
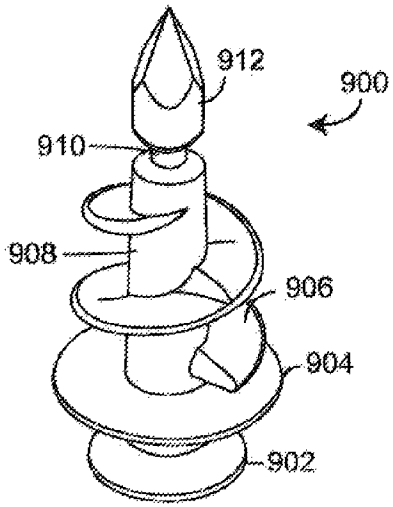
FIG. 9 is a perspective view of the wall auger of the present invention.

Now referring to FIG. 9, there is shown a perspective view of a length adjustable wall auger 900 having a head 902 and spacer disk 904 which would preferably be at or near the level of the drywall when the wall auger 900 is screwed in. The space between spacer disk 904 and head 902 is to allow the drywall wall auger to engage the dual purpose hanging and marking structure 100. A flighting 906 is disposed on a tapered central core 908 which are sized and configured to grasp drywall. Disposed at the end of tapered central core 908 is a thin detachment region 910 which is preferably sized and configured to be cut with a wire cutter or similar tool or broken by bending the cutting tip 912 back and forth to fatigue the detachment region 910. FIG. 10 shows a side view of the same drywall wall auger 900. Cutting tip 912 can be removed to reduce the overall all length of the wall auger so that it is not thicker than the drywall itself, so as to not risk encountering any other matter such as wiring, plumbing, heating ducts or structural members or the like.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A system for hanging an object on a surface comprising:

a hanging structure with a central protruding section that has an arcuate bottom edge that is open in a direction away from a top edge of the central protruding section; and a detachable and re-usable structure temporarily coupled to and protruding from the surface side of the object, wherein the detachable and re-usable structure makes a mark on the surface when it is pressed against the surface, wherein the detachable and re-usable structure is snapped into a substantially rigid connection with the hanging structure, and wherein the detachable and re-usable structure is disconnected from the hanging structure before a fastener is received by the hanging structure at the arcuate bottom edge of the central protruding section, wherein the fastener does not connect to the detachable and re-usable structure.

2. The system of claim 1 wherein the detachable and re-usable structure is configured to detachably and re-usably mate with the central protruding section of the hanging structure.

3. The system of claim 2 wherein the detachable and re-usable structure comprises one or more protuberances, wherein the one or more protuberances are receivable in a corresponding number of voids in the central protruding section of the hanging structure.

4. The system of claim 3 wherein the detachable and re-usable structure comprises a flange configured to aid in removal of the detachable and re-usable structure.

5. The system of claim 4 wherein the hanging structure is affixed to the object via an adhesive or one or more mechanical fasteners.

6. The system of claim 1 wherein the hanging structure further comprising at least two legs that flank the central protruding section and hold the central protruding section apart from the object.

7. A system for hanging pictures on a substantially vertical surface comprising:

a plurality of hanging structures sized and configured to be securely disposed on an object to be hung; and wherein each of the plurality of hanging structures includes a first structure configured to mark a location for a fastener attached to a surface and then be non-destructively detached from a second structure, and wherein the second structure has an arcuate bottom edge that is open in a direction away from a top edge of the second structure and is configured to be hung on a fastener attached at the location, wherein the first structure is initially configured to be temporarily securely held with respect to the second structure and then further configured to be readily and non-destructively detached from the second structure by releasing the first structure from the second structure before the object is hung, wherein the first structure and second structure cooperate to form a snap-fit structure, wherein the first structure does not cooperate with the fastener when the second structure is hung on the fastener.

8. The system of claim 7 wherein the second structure of each hanging structure is spaced from the object when the hanging structure is dispose on the object.

* * * * *